United States Patent [19]

Schneider

[11] Patent Number: 4,763,803

[45] Date of Patent: Aug. 16, 1988

[54] STOPPER FOR A CONTAINER SUCH AS A BOTTLE, AND A PUMP CONNECTABLE THERETO FOR EXTRACTION OF GASEOUS MEDIUM FROM OR PUMPING IN THEREOF INTO THE CONTAINER

[76] Inventor: Bernardus J. J. A. Schneider, Churchilllaan 60, 2625 GW Delft, Netherlands

[21] Appl. No.: 3,784

[22] Filed: Jan. 15, 1987

[30] Foreign Application Priority Data

Jan. 20, 1986 [NL] Netherlands ..... 8600111

[51] Int. Cl.[4] ..... B65D 51/16

[52] U.S. Cl. ..... 215/260; 215/228; 215/311; 141/65

[58] Field of Search ..... 215/228, 260, 311; 141/65

[56] References Cited

U.S. PATENT DOCUMENTS

| | | | |
|---|---|---|---|
| 515,626 | 2/1894 | Schafer | 215/260 |
| 795,642 | 7/1905 | Nelson | 215/311 |
| 1,940,721 | 12/1933 | Martin | 215/315 |
| 2,049,872 | 8/1936 | Jera | 230/239 |
| 2,070,377 | 2/1937 | Simmons | 215/260 |
| 2,168,734 | 8/1939 | Freeman | 215/260 |
| 2,729,381 | 1/1956 | Wiser | 141/64 X |
| 3,084,823 | 4/1963 | Reichstein | 215/311 |
| 3,557,986 | 1/1971 | Poole | 215/228 |
| 3,602,387 | 8/1971 | Patnaude et al. | 215/228 |
| 3,670,915 | 6/1972 | Forman | 215/260 |
| 3,672,114 | 6/1972 | Sacks | 141/65 X |
| 4,142,645 | 3/1979 | Walton | 215/312 X |
| 4,249,583 | 7/1979 | Lundbladh | 141/65 |
| 4,278,114 | 7/1981 | Ruberg | 141/65 |
| 4,558,795 | 12/1985 | Logue | 215/260 |

FOREIGN PATENT DOCUMENTS

| | | | |
|---|---|---|---|
| 623620 | 12/1935 | Fed. Rep. of Germany . | |
| 541622 | 7/1922 | France | 215/311 |
| 931126 | 9/1947 | France . | |
| 345553 | 5/1960 | Switzerland | 215/228 |
| 1046518 | 10/1966 | United Kingdom . | |

*Primary Examiner*—Stephen Marcus
*Assistant Examiner*—Nova Stucker
*Attorney, Agent, or Firm*—Parmelee, Bollinger & Bramblett

[57] ABSTRACT

A stopper having a slit valve is provided for a bottle which is adapted to be used with a pump for evacuating air from the bottle to preserve wine being consumed from the bottle or by increasing the pressure in the bottle, for example, to maintain the carbon dioxide content in a soft drink being consumed from the bottle. The stopper and valve are integral and are made of the same elastic material. The valve is surrounded by a raised circular edge for protecting the slit valve. A circular flange is provided which rests on the top of the bottle neck. The raised circular edge is shaped to sealably receive a pump housing.

22 Claims, 2 Drawing Sheets

STOPPER FOR A CONTAINER SUCH AS A BOTTLE, AND A PUMP CONNECTABLE THERETO FOR EXTRACTION OF GASEOUS MEDIUM FROM OR PUMPING IN THEREOF INTO THE CONTAINER

The invention relates to a stopper for a container such as a bottle, comprising a shaft which fits in clamping and sealing fashion on the opening of the container, such as in the neck of a bottle, and which has a through-going channel which works in conjunction with a non-return valve, said stopper being provided with means for connecting a pump thereto in clamping and/or sealing fashion.

Such a stopper is known from, for example, German Patent Specification No. 623,620. This known stopper consists of a stopper to be inserted into an opening of the container, for example, into the neck of a bottle, which is provided with a central bore. Placed on the top end of this stopper is a rubber cap which with a tapering part sticks into the mouth of the bore and has a pair of openings between its gripping edge which grips the edge of the stopper and the part of the valve sticking into the bore. When there is excess pressure, the valve will be lifted and gases can escape from the container through the then cleared openings. A vacuum can be produced in the container by sucking off the air or vapors or gases still there. To this end, provision is made for a likewise sealing and gripping cup to be placed over the rubber cap, said cup being connected by means of a hose to a pump which consists of a cylinder having therein a piston with piston rod and handle. When a suction stroke is performed with this pump, the valve will, in consequence of the pressure difference, be moved into the open position and medium will thus be extracted from the container. When a delivery stroke is performed by the pump, the valve will close and discharge will have to take place of the extracted medium by means of a valve or opening which is known per se in hand pumps.

This known pump consists of two parts, a pump with hose which is needed to extract medium, and a cup to be placed over the valve, which is a complication, because these parts take up much space, and the connection of the cup over the valve is inadequate. It will often be necessary to press the cup by hand onto the rubber cap, in which case one no longer has two hands free to operate the pump.

Another disadvantage of the rubber cap is that it can become dirty, and the quality of the rubber can deteriorate. Besides, the stopper cannot be removed from the container by hand without forces being exerted at the same time on the rubber cap forming the valve. This can result in damage to the cap and thus to its sealing function.

With many liquids the problem is that their quality deteriorates after the permanent seal required for transport and storage is removed, and only part of the contents are consumed. The liquid then comes into contact with the air after opening of the container. An example of such liquid is wine. If a certain quantity remains in the bottle, its quality can deteriorate when the bottle is closed again, because there is air in the bottle. With the device known from German Patent Specification No. 623,620, this air could be sucked off, in which case the quantity of wine remaining in the bottle will keep longer.

In the case of carbonated drinks, the carbon dioxide will escape on removal of the seal. If only part of the contents are being used, the escape of carbon dioxide gas can be countered to some extent by closing the container again. It would, however, be advantageous for the shelf life of the drink if the escape of carbon dioxide gas from the liquid could be suppressed through the production of excess pressure. With the device known from German Patent Specification No. 623,620, this is not possible.

The object of the invention is then to produce a simple design for the stopper which consists of fewer parts, can work better in conjunction with a pump, is easier to use, and the design principle of which is such that the stopper can also be used with a somewhat modified design for the pumping in of medium.

The object of the invention is also to produce a pump which is particularly suitable for working in conjunction with the stopper according to the invention.

The improved stopper according to the present invention is provided in the form of a stopper and a valve in the stopper which are integral and are made of the same elastic material. The stopper has a shaft with a channel therein and the valve has an opening in the form of a slit which is located in the path of the channel. The stopper is formed so that the slit may be opened. The shaft has a concentric edge surrounding the valve and is shaped to receive a pump.

The fact that the stopper and the valve are integral and the stopper is provided with an edge enclosing the valve part means that the stopper can be placed or removed without difficulty by hand. The edge ensures that during placing or removal of the stopper one does not come into contact with the valve, because the latter is protected by the edge.

This slit valve can open outwards if the stopper is one which has to permit the escape or extraction of medium from the container. The slit valve can also open inwards, looking from the container, if the stopper in question is intended for a container into which a medium has to be forced under pressure.

The parts which form the slit valve can be held in the closed position either by the elastic properties of the material or by a pressure difference on either side of the valve, either alone or in combination with a difference in surface forces which press the parts of the slit valve onto each other work at the side with the higher pressure.

The edge is preferably a raised edge whose function is to protect the valve therein and to connect the pump thereto. For taking hold of or connecting the pump, it is also advantageous if a circular flange is positioned between the raised edge and the shaft which projects outwardly beyond the raised edge.

The slit valve is preferably formed by a slit in a rib which extends crosswise over the channel and connects to the opposite zones of the raised edge. This design has the advantage that pressure can be exerted on the edge in the direction of the rib, in such a way that when the edge zones are moved towards each other the slit is opened. This can be promoted further if according to the invention the sides of the ribs transverse to the plane of the slit are connected to the edge by means of ribs. These ribs standing transversely to the rib will promote opening of the slit when the edge is pressed in and thus also to an oval shape.

The stopper according to the invention is not a pouring spout and must therefore be removed when liquid has to be taken again from the container. If, however, a vacuum is produced in the container through the extraction of air, the stopper will be difficult to remove. The design of the stopper with the above-mentioned rib or ribs has the advantage then that on grasping of the stopper the slit can readily open, as a result of which air can flow in and the vacuum is released.

Instead of the slit valve described, which is formed by an incision in a rib, the slit can also be formed by an incision in part of a cap extending crosswise over the channel, said incision being preferably transverse to the axis of the channel. Such a cap can be conical in shape, with the top being partially cut open and in that way acting as a valve. The release of the vacuum can also take place here in a simple manner by pressing with one finger against the top of the cap.

The slit can also be formed by a partial incision in an end wall of a tubular part, close under the end wall, said tube forming part of the channel.

Other embodiments of slit valves are conceivable, provided that the condition of stopper and valve being made of one and the same material is met.

It is pointed out that the published German application No. 1,102,538 discloses a device for the production of a vacuum in a container, such as a preserves container. Here the container has a lid with a central opening over which can be placed a closing cap of elastic material which serves as a valve, and which must rest with its edge in sealing fashion against the top face of the lid, and has a conical central section which can stick into the opening of the lid. The closure here thus consists of one single material, and this closure has a valve effect. However, this closure is not in the form of a stopper which is placed in clamping and sealing fashion on the opening of a container, but is a cap which is held in place purely by the pressure difference and which with the slightest soiling or unevenness of the top face of the lid or the edge of the cap will exhibit leakage and will then lose its closing effect. Besides, the cap can easily come off, for example if someone knocks against it.

According to the invention, the stopper preferably consists of a cylindrical part which is provided at several points with thin circular cross flanges in planes perpendicular to the center line of the stopper. The external diameter of the shaft is then slightly smaller than the neck opening, for example of a bottle, and the thin flanges ensure a good closure.

The invention also relates to a pump, in particular a pump for working in conjunction with the stopper according to the invention. A pump comprising a cylinder, a piston in this cylinder, a piston rod and a handle is known, for example from the above-mentioned German Patent Specification No. 623,620.

The object of the invention is then to produce a pump which not only can work in conjunction with the stopper, but which is also simple in design and is sturdy, and which does not have the disadvantage that during the pumping great heat development takes place where in known pumps the piston cup leather has to be able to ensure both the sealing during the stroke in one direction and the passage of the medium during the stroke in the opposite direction.

To this end, the pump according to the invention consists of a piston rod in the form of a hollow pipe whose diameter is slightly smaller than the internal diameter of the cylinder, the piston is integral with the piston rod and the latter has a cross wall which is perpendicular to its center line and has a central opening, and the cylinder has an end facing away from the handle which fits in sealing fashion on the stopper, in particular on the edge or flange of the stopper. This piston rod designed in the form of a pipe is sturdy and permits good guidance into the housing of the pump, said housing or cylinder being directly connectable to the stopper. A hose connection of the known type is then no longer necessary.

It is desirable in the fully pushed-in position of the piston rod for the piston to be at a distance from the end facing away from the handle which corresponds to the distance which the cylinder can grip over the top side of the stopper when it is placed on the stopper.

This pump can be designed without any valve in it. In the central opening of the cross wall, which is preferably at the same height as the piston part, a valve can, however, be fitted, preferably in the form of a mushroom valve of elastic material with a stem which fits with play into the opening, a disc which can seal on the edge of the opening, and a thickened part which on fitting can be pressed through the opening but with the valve in use stays in the opening. Such a valve can be placed in two positions depending on whether the pump has to serve for the extraction of medium or for pumping in medium. The piston rod in both cases must have an escape opening for connection with the outside air. If no valve is used, the piston rod must be closed. Moreover, after each suction or delivery stroke the pump has to be removed from the stopper before the piston is returned to its initial position. After the return of the piston to its initial position, the pump is again placed on the stopper and the next suction or delivery stroke is carried out if the stopper is one which permits this.

All parts are preferably made of plastic, while the stopper is preferably of an elastic synthetic material or rubber, which can therefore of course be natural or synthetic rubber. The elastic synthetic material can be a thermoplastic material, but is in particular a plastic which is neutral as regards the contents of the container. Examples of materials are: polyethylene, polyurethane and polyamides, in particular thermoplastic rubber for the stopper.

The pump is preferably made of a rigid plastic or a more rigid plastic, such as polyamide, in particular polypropylene and A.B.S. This more rigid plastic can be a thermoplastic or a thermosetting plastic.

The invention will now be explained in greater detail below with reference to the drawings.

Figure 4:
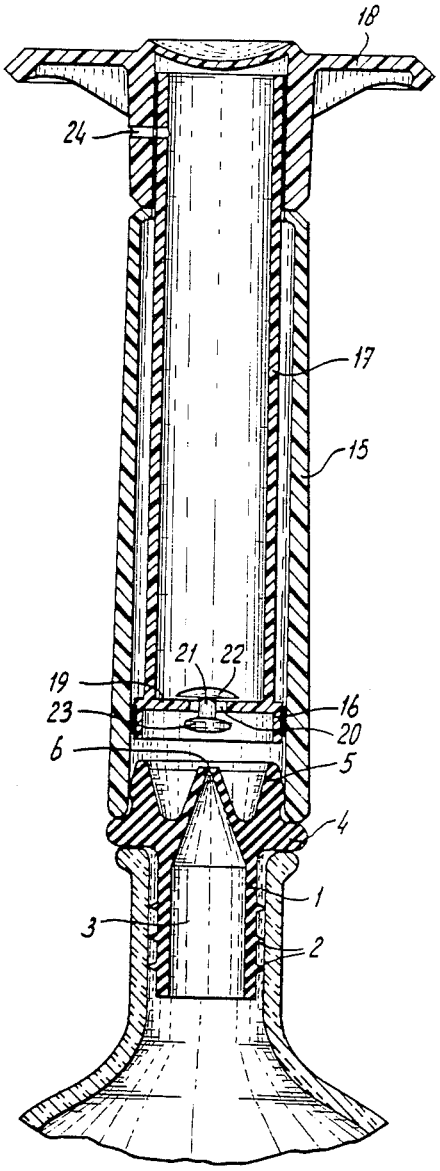
FIG. 4 shows the stopper of FIG. 1 in cross section, with an embodiment of the pump, also in cross section, placed thereon.
Figure 7:
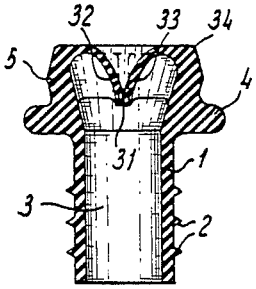
FIG. 7 shows a variant of the stopper according to the invention suitable for pumping in of medium.
Figure 8:
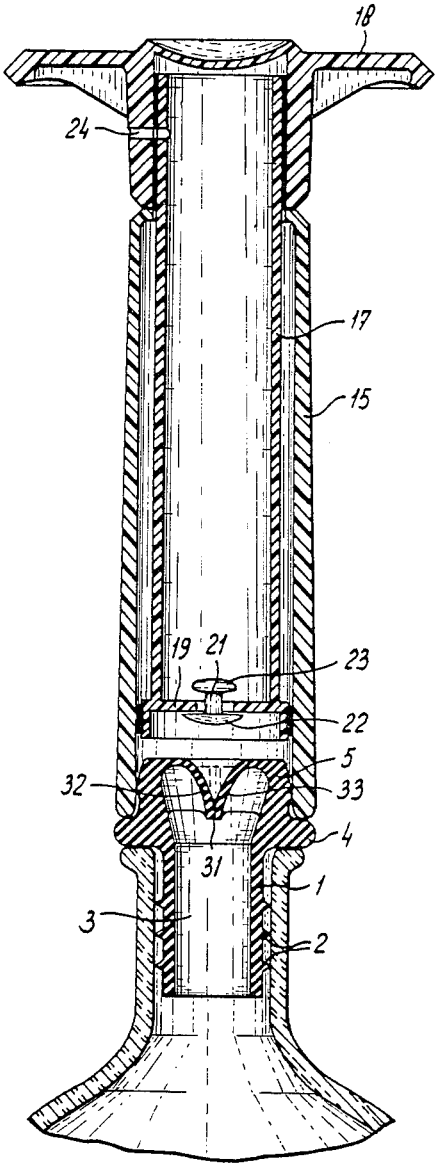

FIG. 8 corresponds to FIG. 4 and shows the placing of the pump on the stopper of FIG. 7.

Figure 1:
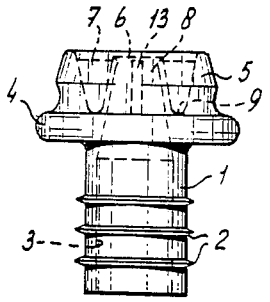
FIG. 1 shows a side view of a stopper according to the invention.
Figure 2:
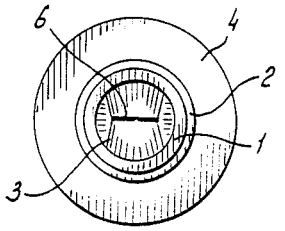
FIG. 2 shows a bottom view of FIG. 1.
Figure 3:
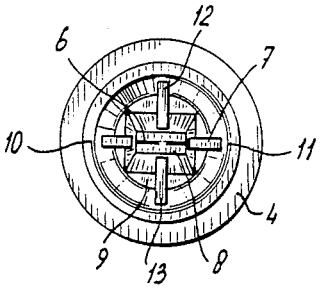
FIG. 3 shows a top view of FIG. 1.

The stopper shown in FIGS. 1, 2 and 3 comprises a shaft 1 which is provided with a number of thin sealing flanges 2 and has a central channel 3 which is indicated by dotted lines.

The stopper has a flange 4 and a raised top edge 5.

Inside this edge 5 is a slit valve. The slit of this slit valve is indicated by 6 and is formed by an incision or slit in a rib 7 whose central part is thickened at 8. This rib 7 is located above a bottom wall 9. The thickened parts 8 of the rib 7 on either side of the slit 6 ensure that the slit opens when there is pressure difference. This slit can also be opened if pressure is exerted with the fingers on the opposite points 10 and 11. The edge 5 is then pressed to an oval shape. It is then advantageous if there are also ribs 12 and 13. During the pressure to an oval shape, the ribs will ensure that the parts 8 are drawn apart on either side of the slit 6.

FIG. 4 shows a stopper with a shaft 1 and sealing edges 2, a flange 4 and a top edge 5 as shown in FIG. 1, but turned 90 degrees, so that the slit can be seen in cross section.

The pump comprises a pump housing 15 with therein a piston 16 having a pipe-shaped piston rod 17 on which a handle 18 is fixed in some suitably way or other, such as gluing, clamping etc. The piston 16 is integral with the piston rod 17, and the latter has at the level of the piston a cross wall 19 with a central opening 20.

Shown in this central opening is a rubber mushroom-shaped non-return valve, comprising a stem 21, a valve disc 22, and a locking button 23. This locking button is such that the valve can be pressed into the opening in the manner of a push button and can then move axially, said movement being determined by the length of the stem 21, which sits with some play in the opening 20. This valve can be placed in the position shown, but can, of course, also be placed in the reverse position shown in FIG. 8.

At 24 there is an opening in the piston rod and handle 18. This pump can be used to extract medium from a container through the stopper 1 placed thereon. Starting from the initial position shown in FIG. 4, when the piston rod and piston move upwards the valve disc 22 will move into the closing position, in which it rests on the top face of the wall 19. During this suction stroke medium will be extracted from the container through the slit 6. When the piston is subsequently moved downwards, this medium will pass through the valve 22 into the chamber inside the piston rod 17 and can escape through the opening 24. Several piston strokes can be carried out in this way.

It is, however, also conceivable to design the pump shown in FIG. 4 without the valve in the opening 20 and without the opening 24. In that case, after each suction stroke the pump must be taken from the stopper, and the piston then returned to the initial position shown in FIG. 4. The next suction stroke can be carried out after the pump is placed on the stopper.

In the embodiment shown in FIG. 8 the valve 22 is the other way round and thus lies with its disc 22 against the under side of the wall 19. When the piston is raised, air will be able to pass through the opening 20 under the piston, and on the delivery stroke can be pressed into the container through the slit of the stopper shown in FIG. 7 and in FIG. 8.

In this case also the pump can be designed without the valve and without the opening 24, and air can be pressed into the container, provided that before each delivery stroke the piston is always taken to the top position before the pump is placed on the stopper.

Without the valve and without the opening 24, thus with a closed piston rod, the pump can be used both for extraction and for pumping in.

Figure 5:
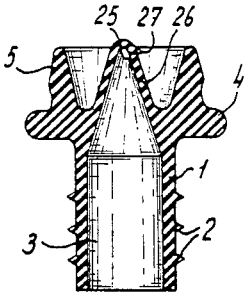
FIG. 5 shows a cross section of a variant of the stopper according to the invention.

FIG. 5 shows a variant of the slit valve. It comprises an incision 25 in a conical cap 26. The top of the cap can have a projecting lip 27 which facilitates opening by hand.

Figure 6:
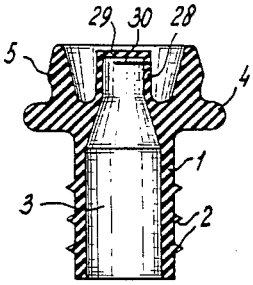
FIG. 6 shows a cross section of another variant of the stopper according to the invention.

In the embodiment of FIG. 6 the channel of the stopper has a tubular part 28 with an end wall 29 inside the edge 5. The slit valve is formed here by an incision 30 close under the end wall 29, so that during flow in the upward direction, for example, during suction, the end wall 29 can be raised and serves as a valve.

FIG. 7 shows an embodiment suitable for the pumping in of medium, said embodiment being in principle the reverse of the embodiment shown in FIGS. 1–4. Slit valves of the type shown in FIGS. 5 and 6 can, of course, also be used in the reverse form.

In the embodiment shown in FIG. 7 the slit 31 of the slit valve is formed by an incision or the like between the parts 32 and 33 of a rib running crosswise over the valve at the side of the edge 34 to the other side. Excess pressure at the under side will hold the valve shut and it will open when there is excess pressure at the outside.

In this case also, pressing open by hand is possible in the same way as that described with reference to FIG. 3.

I claim:

1. The stopper for a bottle or similar type container adapted to have a pump device mounted thereon comprising a shaft having an axis for said stopper, said stopper adapted to fit in clamping and sealing relation inside the neck of a bottle, said shaft having a channel therethrough provided with a membrane type non-return valve, said stopper having a portion outside the neck of the bottle when positioned in the neck of the bottle which portion is adapted to receive in clamping relation a suction-pressure pump device, the improvement comprising:

said stopper and membrane valve are integral and made of the same elastic material, said membrane valve having a slit with cooperating elastic parts on opposite sides thereof of the same material as said stopper, said membrane valve positioned to close said channel, and said portion of said stopper adapted to receive the pump device having a radially extending circumferential flange extending outside the neck of the bottle when mounted thereon and being perpendicular to the axis of said stopper and adapted to rest upon the neck of a bottle, said portion of said stopper having a circumferential ridge concentric with said circumferential flange and having an outer diameter smaller than the outer diameter of said circumferential flange, said ridge having an outer conical side face tapering away from said circumferential flange towards said axis of said stopper, said circumferential ridge surrounding said membrane valve which together with said circumferential flange may sealably receive a pump device.

2. The stopper as claimed in claim 1 wherein said valve opens outward, viewed from the container along said axis of said stopper.

3. The stopper as claimed in claim 1 wherein said valve opens inward, viewed from the container along said axis of said stopper.

4. The stopper as claimed in claim 1 wherein said valve is formed by said slit in a plane which coincides with said axis of said stopper, said slit is made in the top of a central tapering portion having outer walls which emerge into said circumferential ridge.

5. The stopper as claimed in claim 4 wherein said tapering portion with said valve has sides which are connected to said circumferential ridge by means of ribs which extend in the plane of said slit and by means of ribs which extend in a plane transverse to the plane of said slit.

6. The stopper as claimed in claim 1 having a pump for use with said stopper device comprising a cylinder, a piston in said cylinder, a piston rod extending outside said cylinder and a handle at the outer end of said piston rod, the improvement comprising that the piston rod is a hollow pipe having a diameter which is slightly smaller than the internal diameter of said cylinder, said piston forming an integral part with said piston rod and having a cross wall which extends perpendicular to said piston rod, said cylinder having a lower end portion extending beyond the piston of a distance sufficient to prevent engagement of the piston with said stopper when the lower end portion of said cylinder is placed upon said circumferential flange of said stopper.

7. The stopper as claimed in claim 6 wherein the cross wall of the piston rod has a central opening housing a non-return valve of the mushroom type made from elastic material and having a stem with a first and second end which fits with play into said central opening, a disk mounted on said first end of said stem, said opening and a thickened part mounted on the second end of said stem, which can be pressed through the opening but in use keeps said valve in place.

8. The stopper as claimed in claim 7 wherein said stopper is made from an elastic synthetic material or rubber and said pump device is made of a rigid synthetic material such as a polyamide.

9. The stopper as claimed in claim 6 wherein said stopper is made from an elastic synthetic material or rubber and said pump device is made of a rigid synthetic material such as polyamide.

10. A stopper and pump apparatus for evacuating gas from a bottle or the like or for the application of pressure by forcing gas into said bottle having a stopper with a shaft for insertion and removal from the neck of a bottle, said shaft having a central channel therein and a valve for opening and closing said central channel and a hand-operates pump coupled to said stopper, the improved stopper and pump apparatus comprising:

a peripheral flange on said stopper having an outside diameter larger than the outside diameter of said shaft whereby when said stopper is inserted into the neck of a bottle the shaft of the stopper extends downwardly into the neck of the bottle with said peripheral flange resting on the top of the bottle, a circumferential ridge concentric with, spaced inwardly on, and extending upwardly from said peripheral flange forming an annular shelf therewith, said hand operated pump having a downwardly extending annular skirt adapted to be seated for frictional and sealing engagement with said annular shelf whereby said hand operated pump is engageable with and operated directly on said stopper for changing the pressure in said bottle.

11. The apparatus as claimed in claim 10 wherein said valve is a lip valve formed by a slit in an elevated element mounted in and closing said channel when said slit is closed.

12. The apparatus as claimed in claim 11 wherein said elevated element of said lip valve is supported by a first set of integral ribs secured to said circumferential ridge which first set of ribs are parallel to said slit in said valve whereby pressure on said circumferential ridge adjacent said first set of ribs opens said slit of said lip valve.

13. The apparatus as claimed in claim 12 wherein a second set of integral ribs transverse to said first set of integral ribs is secured between said circumferential ridge and said elevated element of said lip valve, said elevated element having a trapezoidal configuration.

14. The apparatus as claimed in claim 10 wherein said pump has a cross wall therein closing said pump from which annular skirt extends, a non-returnable valve having first and second orientations, said non-returnable valve mounted centrally in said cross wall.

15. The apparatus as claimed in claim 14 wherein said non-return valve is mounted in said cross wall in said first orientation permitting gas to be removed from a bottle in which said apparatus is mounted.

16. The apparatus as claimed as in claim 14 wherein said non-return valve is mounted in said cross wall in said second orientation which permits pressure to be applied into a bottle to which said apparatus is attached.

17. The apparatus as claimed in claim 10 wherein said pump comprises: a cylinder, a piston in said cylinder, a piston rod and a handle, characterized in that the piston rod is a hollowpipe whose diameter is slightly smaller than the internal diameter of the cylinder, the piston is integral with the piston rod and said piston has a cross wall perpendicular, to said piston rod with a central opening, and the cylinder has said annular skirt on an end facing away from the handle, and fitting in sealing engagement on the stopper.

18. The apparatus as claimed in claim 17 wherein when said handle is in a fully pushed in position and said piston is at a distance from the end facing away from the handle corresponds to the distance said annular skirt grips said annular shelf of the stopper when placed on the stopper.

19. The apparatus as claimed in claim 17 wherein said piston there is a non-return valve in the central opening of the piston has a central opening therein having a non-return valve positioned therein.

20. The apparatus as claimed in claim 19 wherein said valve is a mushroom valve of elastic material with a stem which fits with play into said central opening, a disc which can seal said opening, and a thickened part which can be pressed through said central opening but in use in said valve stays in the opening.

21. The apparatus as claimed in claim 10 wherein said stopper is made of an elastic synthetic material or rubber.

22. The apparatus as claimed in claim 10 wherein said pump is made of a rigid plastic, such as a polyamide.

* * * * *

UNITED STATES PATENT AND TRADEMARK OFFICE

CERTIFICATE OF CORRECTION

PATENT NO. : 4,763,803

DATED : August 16, 1988

INVENTOR(S) : Bernardus J.J.A.Schneider

It is certified that error appears in the above-identified patent and that said Letters Patent is hereby corrected as shown below:

Column 8, Claim 19, lines 48 and 49 delete "there is a non-return valve in the central opening of the piston".

Claim 19 thereby reads as follows:

19. The apparatus as claimed in Claim 17 wherein said piston has a central opening therein having a non-return valve positioned therein.

Signed and Sealed this

Sixth Day of July, 1993

*Attest:*

Michael K. Kirk

MICHAEL K. KIRK

*Attesting Officer*

*Acting Commissioner of Patents and Trademarks*